US009468968B2

(12) United States Patent
Figiel et al.

(10) Patent No.: US 9,468,968 B2
(45) Date of Patent: Oct. 18, 2016

(54) BATTERY POWERED TENSIONING TOOL FOR STRAP

(71) Applicant: Illinois Tool Works Inc., Glenview, IL (US)

(72) Inventors: Janusz Figiel, Mundelein, IL (US); Michael J. Kaufman, Morton Grove, IL (US); Jason R. Nasiatka, Northbrook, IL (US); Joseph J. Gardner, Elk Grove Village, IL (US); Walter L. Boss, Lindenhurst, IL (US)

(73) Assignee: Signode Industrial Group LLC, Glenview, IL (US)

( * ) Notice: Subject to any disclaimer, the term of this patent is extended or adjusted under 35 U.S.C. 154(b) by 556 days.

(21) Appl. No.: 13/933,981

(22) Filed: Jul. 2, 2013

(65) Prior Publication Data

US 2014/0060345 A1 Mar. 6, 2014

Related U.S. Application Data

(60) Provisional application No. 61/760,482, filed on Feb. 4, 2013, provisional application No. 61/745,180, filed on Dec. 21, 2012, provisional application No. 61/695,178, filed on Aug. 30, 2012.

(51) Int. Cl.

| | |
|---|---|
| ***B65B 13/22*** | (2006.01) |
| ***B21F 9/00*** | (2006.01) |
| ***B65B 13/02*** | (2006.01) |

(52) U.S. Cl.

CPC ..... *B21F 9/002* (2013.01); *B65B 13/025* (2013.01); *B65B 13/22* (2013.01)

(58) Field of Classification Search

CPC ..... B21F 9/002; B65B 13/22; B65B 13/025; B65B 13/00; B65B 13/02

See application file for complete search history.

(56) References Cited

U.S. PATENT DOCUMENTS

| | | | |
|---|---|---|---|
| 2,936,456 | A | 5/1960 | Coupland |
| 6,073,664 | A | 6/2000 | Angarola |

(Continued)

FOREIGN PATENT DOCUMENTS

| | | | |
|---|---|---|---|
| CN | 201411057 | Y | 2/2010 |
| CN | 102256875 | A | 11/2011 |
| CN | 202244155 | U | 5/2012 |

OTHER PUBLICATIONS

PAC Strapping Products Inc., Plastic Strapping Tools VT550L and VT700L. Copyright 2011.*

(Continued)

*Primary Examiner* — Jimmy T Nguyen

(74) *Attorney, Agent, or Firm* — Levenfeld Pearlstein, LLC

(57) ABSTRACT

A tensioner for strap includes a housing, a battery, a motor, a tension head having a tension wheel operably connected to the motor and a nosepiece having a pinch element. The nosepiece is mounted to the tension head for movement relative thereto. An actuator handle is mounted to the nosepiece to move the pinch element toward and away from the tension wheel. A strap sensor is operably connected to a controller and senses the presence or absence of strap between the tension wheel and the pinch element. A home position switch senses pinch wheel proximity to the tension wheel. The nosepiece is moved away from the tension head to introduce strap to the tool and the home position switch changes state to signal the controller to permit actuation of the motor when the strap sensor senses the presence of strap between the pinch element and the tension wheel.

25 Claims, 17 Drawing Sheets

(56) References Cited

U.S. PATENT DOCUMENTS

| | | | | |
|---|---|---|---|---|
| 6,308,760 | B1 * | 10/2001 | Finzo | B65B 13/025 100/33 PB |
| 7,155,885 | B1 | 1/2007 | Nasiatka et al. | |
| 7,497,068 | B2 | 3/2009 | Nasiatka et al. | |
| 7,562,620 | B1 | 7/2009 | Nasiatka et al. | |
| 9,085,070 | B2 * | 7/2015 | Skonieczy, Jr. | B65B 13/027 |
| 2010/0139805 | A1 * | 6/2010 | Sledzinski | B65B 13/185 140/93.2 |
| 2011/0056390 | A1 | 3/2011 | Neeser et al. | |
| 2011/0056391 | A1 * | 3/2011 | Neeser | B65B 13/18 100/29 |
| 2011/0056392 | A1 * | 3/2011 | Neeser | B65B 13/025 100/29 |
| 2011/0100233 | A1 * | 5/2011 | Neeser | B65B 13/025 100/2 |
| 2012/0210682 | A1 | 8/2012 | Gardner et al. | |
| 2013/0327438 | A1 * | 12/2013 | Sledzinski | B65B 13/027 140/93 R |
| 2014/0007781 | A1 * | 1/2014 | Sikora | B65B 13/025 100/29 |
| 2014/0083311 | A1 * | 3/2014 | Bonifazi | B65B 13/025 100/4 |
| 2014/0290179 | A1 * | 10/2014 | Keller | B29C 66/1122 53/399 |
| 2015/0033959 | A1 * | 2/2015 | Finzo | B65B 13/025 100/2 |
| 2015/0034206 | A1 * | 2/2015 | Finzo | B65B 13/025 140/93.2 |
| 2015/0210411 | A1 * | 7/2015 | Finzo | B65B 13/025 100/29 |
| 2015/0246739 | A1 * | 9/2015 | Finzo | B65B 13/025 100/32 |

OTHER PUBLICATIONS

SIGNODE, BXT2-19 Battery Powered Combination Tool. Copyright 2015.*

Midwest Industrial Packaging, MIP-GRIP-1141 battery powered tensioner. Copyright 2014.*

SIGNODE, BXT2-25/32 Battery Powered Combination Tool. Copyright 2015.*

International search report for PCT/US2013/057134 dated Oct. 25, 2013.

* cited by examiner

TRIGGER FUNCTIONS 1) (∘) WHEN IN "READY" WILL BEGIN THE TENSIONING CYCLE 2) ( - ) WHEN IN "READY" WILL CAUSE THE TOOL TO REVERSE UNTIL THE TRIGGER IS RELEASED 3) (•) ANYTIME DURING TENSION WILL STOP THE MOTOR AND GO IN REVERSE FOR A SPECIFIED TIME.

(•) INDICATES THE TRIGGER IS HELD FOR LESS THAN A SPECIFIED TIME ( - ) INDICATES THE TRIGGER IS HELD FOR MORE THAN A SPECIFIED TIME

BATTERY POWERED TENSIONING TOOL FOR STRAP

BACKGROUND

Strapping material is used in a wide variety of applications to secure or bundle loads. The strap material is typically metal or plastic and can be applied and tensioned around the load using either a manual or an automatic tensioning tool or tensioner. In one use, a loop of strap material is positioned around a load with a crimp seal loosely placed around the overlying courses of strap material. The tensioner is then used to draw tension in the upper strap course, by positioning the crimp seal at the nosepiece of the tool and drawing the upper strap course.

Manual tensioners use a manual lever or handle operably connected to a tension wheel to draw tension in the strap and to hold tension as a seal is made in the strap. Although manual tensioners function well, they require manual operation. This can be a labor intensive undertaking and can, when carried out numerous times in a day, be very fatiguing. Moreover, the position or orientation of the strap or load may make using a manual tensioner awkward or difficult, especially after repeated uses.

Automatic tensioners are known that use pneumatic circuits to drive a tension wheel to tension the strap. While such tensioners function well, a source of compressed gas, such as compressed air, must be available for operation of the tool. Thus, such a tool has limited use when needed in a location that does not have a compressed air source readily available.

Accordingly, there is a need for a powered strap tensioner. Desirably, such a tensioner is portable and can be used anywhere as needed. More desirably still, such a tensioner is powered by an on-board source and can operate through an automatic tensioning cycle.

SUMMARY

Various embodiments of the present disclosure provide a powered device for tensioning strap material around a load.

In an embodiment, a tensioning tool or tensioner for strap includes a housing, a local power supply such as a battery, a motor, a tension head, a nosepiece and a controller. A tension wheel is positioned in the tension head and is operably connected to the motor. The tension wheel can be connected to the motor through a drive train. The drive train can include a speed reduction gear set, such as a planetary gear set.

The nosepiece can be operably mounted to the tension head for pivoting movement relative to the tension wheel. The nosepiece includes a pinch element, for example, a pinch wheel and is mounted to bias the pinch wheel toward the tension wheel. In an embodiment an actuator handle is operably connected to the nosepiece to move the pinch wheel toward and away from the tension wheel.

In an embodiment, a strap sensor is positioned to sense the presence and/or absence of strap between the tension wheel and the pinch wheel and a home position switch changes state when the nosepiece is moved from a closed position. A home position switch engaging element engages the home position switch when the nosepiece is closed.

The controller can be operably connected to the strap sensor and the home position switch. In an embodiment, when the nosepiece is moved away from the tension head to introduce strap between the tension wheel and the pinch wheel, the home position switch engaging element disengages from the home position switch changing the state of the home position switch to signal the controller to permit actuation of the motor when the strap sensor senses the presence of strap between the pinch wheel and the tension wheel.

An actuation switch can be operably connected to the controller. In an embodiment, the actuation switch can generate a signal to the controller to reverse a direction of the motor. The actuation switch can be, for example, a push-button type switch. The signal can be generated by a prolonged depression of the actuation switch.

The tensioning tool can also include a wake switch to wake the tensioner from a sleep state. In an embodiment, the wake switch is engaged by an engaging element on the handle.

In an embodiment, the strap sensor is a proximity switch that is configured to detect the presence and/or absence of strap positioned between the tension wheel and the pinch wheel. Upon sensing the absence of strap between the tension and pinch wheels, the strap sensor generates a signal to the controller to prevent actuation of the motor.

An embodiment of the tensioner has an automatic tensioning cycle. The tensioner includes a housing, a power supply, a motor, a tension head having a tension wheel operably connected to the motor and a controller. The motor can be connected to the tension wheel by a drive train that includes a speed reduction gear set.

A nosepiece is biasedly mounted to the tension head for movement relative to the tension head between an open state and a closed state. The nosepiece includes a pinch wheel.

A home position switch can be operably connected to the controller for determining when the nosepiece is in the closed state and a strap sensor can be operably connected to the controller to sense the presence and/or absence of strap between the tension wheel and the pinch wheel. In an embodiment, in the automatic tensioning cycle, when the nosepiece is in the closed state, the home position switch generates a signal to the controller to reset the controller. When the nosepiece is moved from the closed state to the open state, the home position switch generates a signal to the controller to allow actuation of the motor when the strap sensor senses the presence of strap between the tension wheel and the pinch wheel.

An embodiment of the tensioner can include an actuation switch operably connected to the controller. The actuation switch can be configured to, at least in part, generate a signal to the controller to reverse a direction of the motor. A push-button type can be used.

The strap sensor can be a proximity switch and configured such that the proximity switch detects the presence and/or absence of strap positioned between the tension wheel and the pinch wheel, and sensing the absence of strap between the tension wheel and the pinch wheel, it generates a signal to prevent actuation of the motor.

In an embodiment, the power supply is a battery detachably mounted to the housing. The motor, the controller and the drive train can be modular and each the motor, the controller and the drive train can be removed as individual components from the tensioner.

These and other features and advantages of the present device will be apparent from the following detailed description, in conjunction with the appended claims.

DETAILED DESCRIPTION

Figure 1:
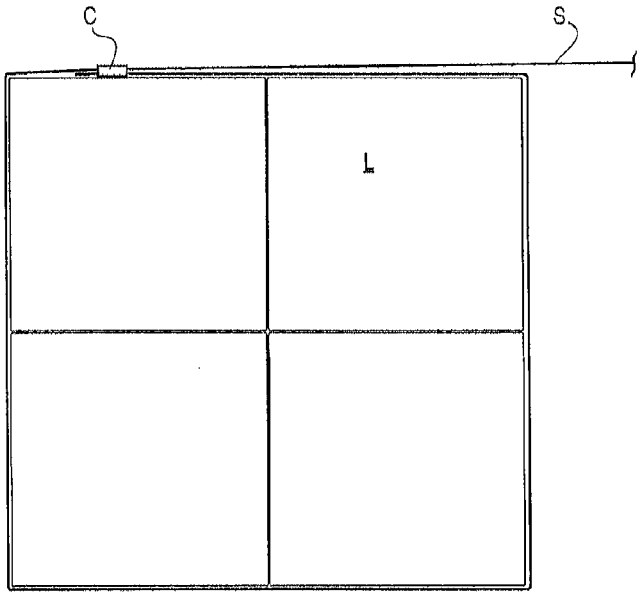
FIG. 1 is a diagrammatic representation showing a strap positioned on a load with a crimp seal positioned on the strap.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment or embodiments described or illustrated.

Figure 3:
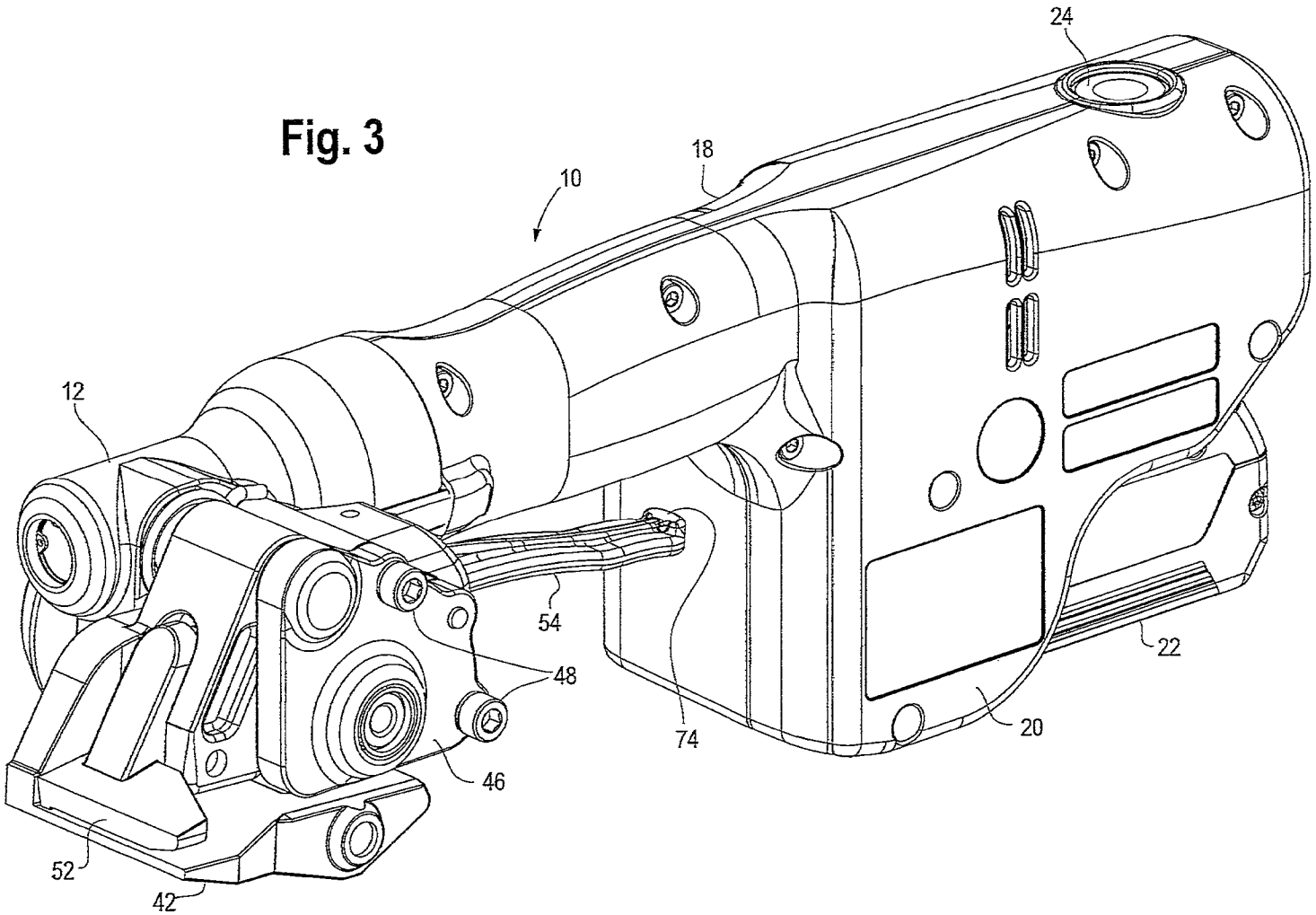
FIG. 3 is a front perspective view of the tensioner.
Figure 4:
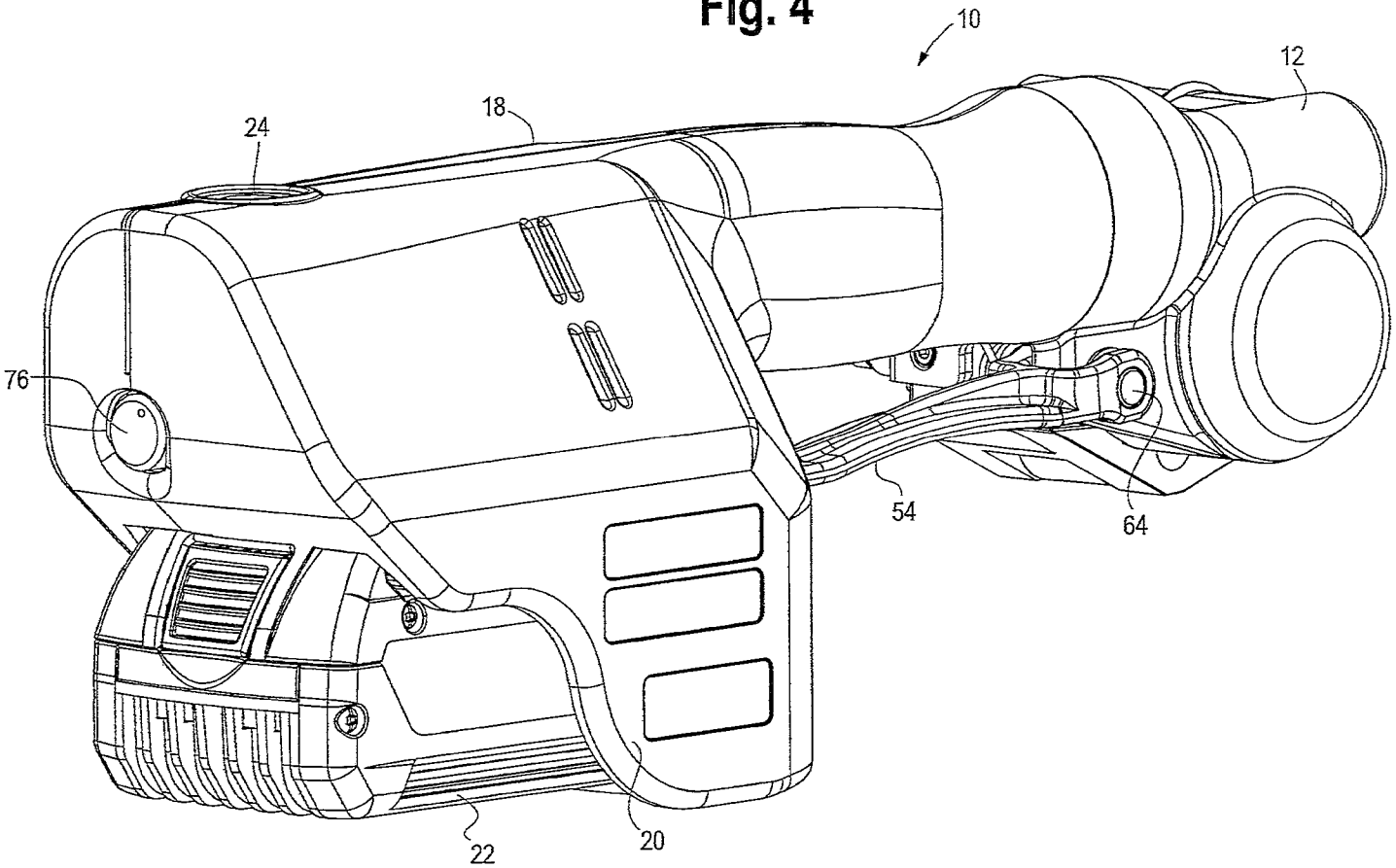
FIG. 4 is a rear perspective view of the tensioner.

Referring now to the figures and in particular to FIGS. 3 and 4 there is shown an embodiment of a battery powered tensioning tool or tensioner 10 for strap S. The tensioner 10 includes, generally, a tensioning head 12, a motor 14 and drive train 16, an enclosure section or housing 18, a battery holder 20 and a battery 22. The drive train/motor housing 18 serves as a hand grip for the tensioner 10. The battery 22 is positioned in the battery holder 20. The battery 10 can be, for example, a lithium-ion or nickel cadmium battery having an operational voltage of about 14.4 to 24 volts inclusive.

An actuation 24 switch is located on the housing 18. In an embodiment, the switch 24 can be an electronic switch that is configured as a multi-function switch as will be described below. The actuation switch 24 can be operably connected to a controller 26 that is configured to control the overall operation of the tensioner 10.

Figure 5:
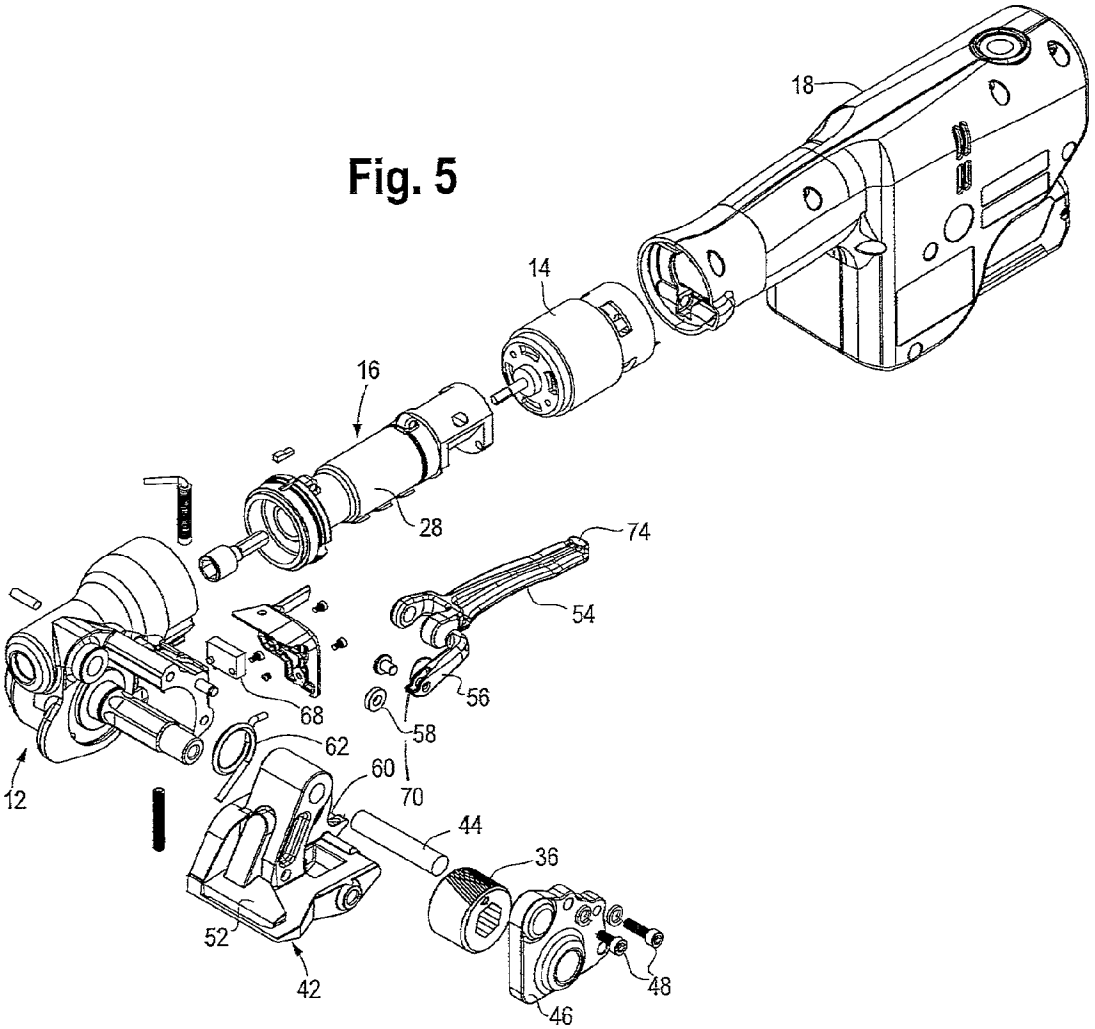
FIG. 5 is a partial exploded view of the tensioner showing the housing, motor and drive train, and tension head.
Figure 6:
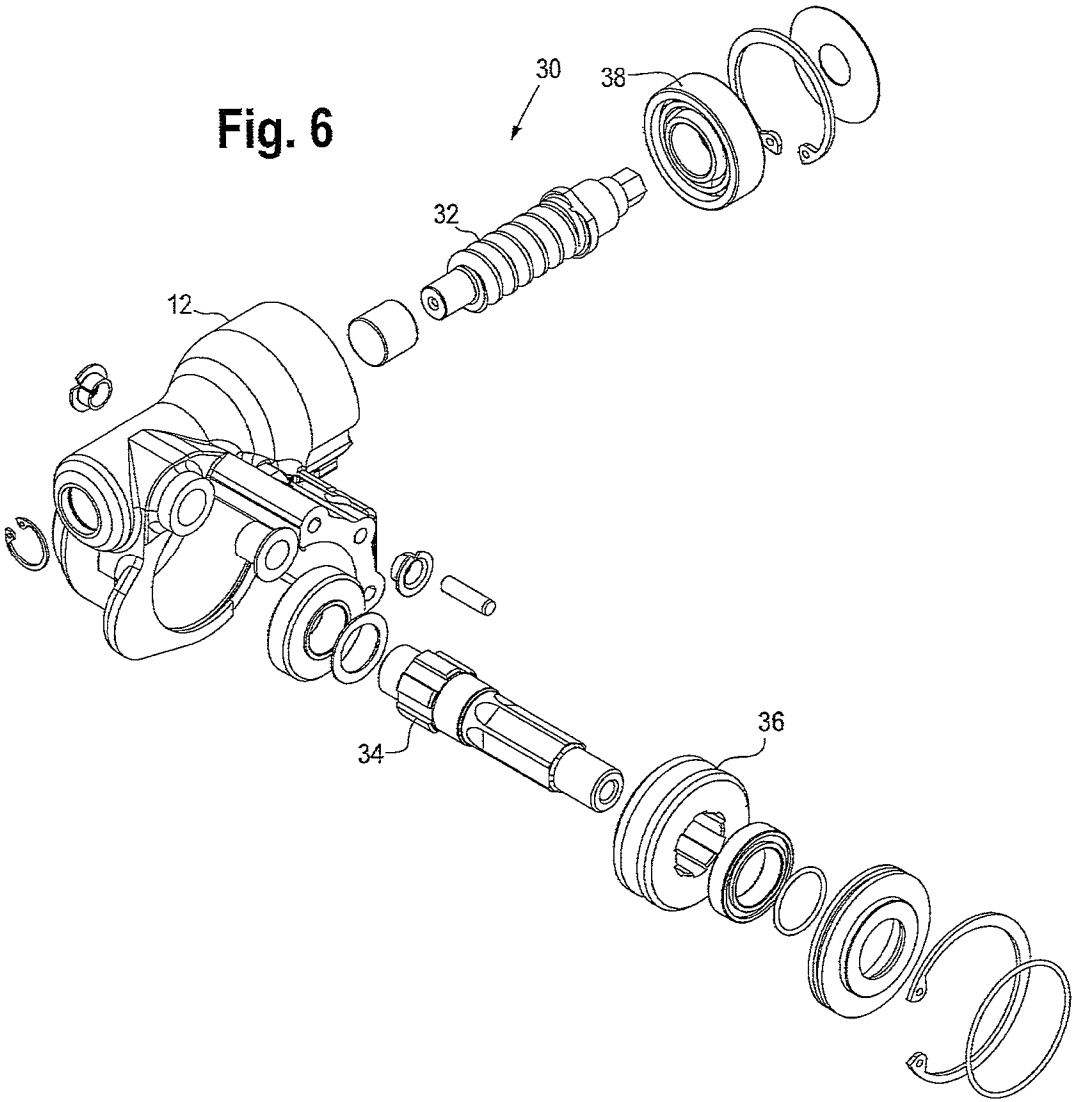
FIG. 6 is a partial exploded view of the drive train and tension head.
Figure 7:
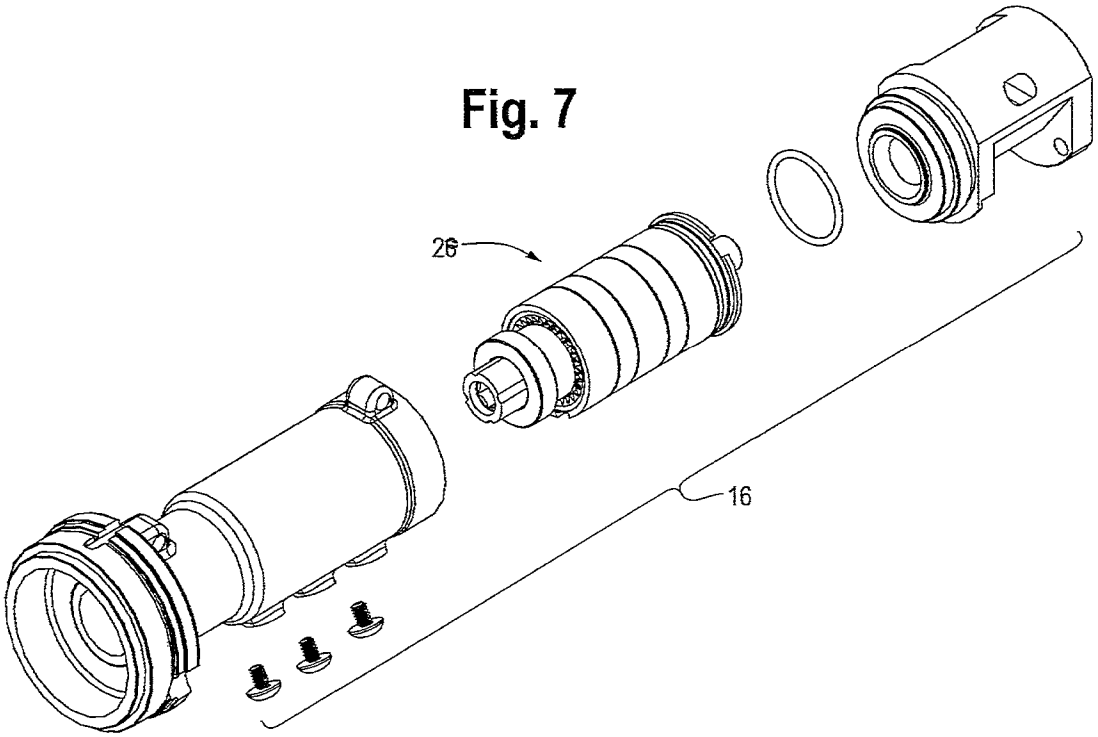
FIG. 7 is a partial exploded view of the drive train.
Figure 11:
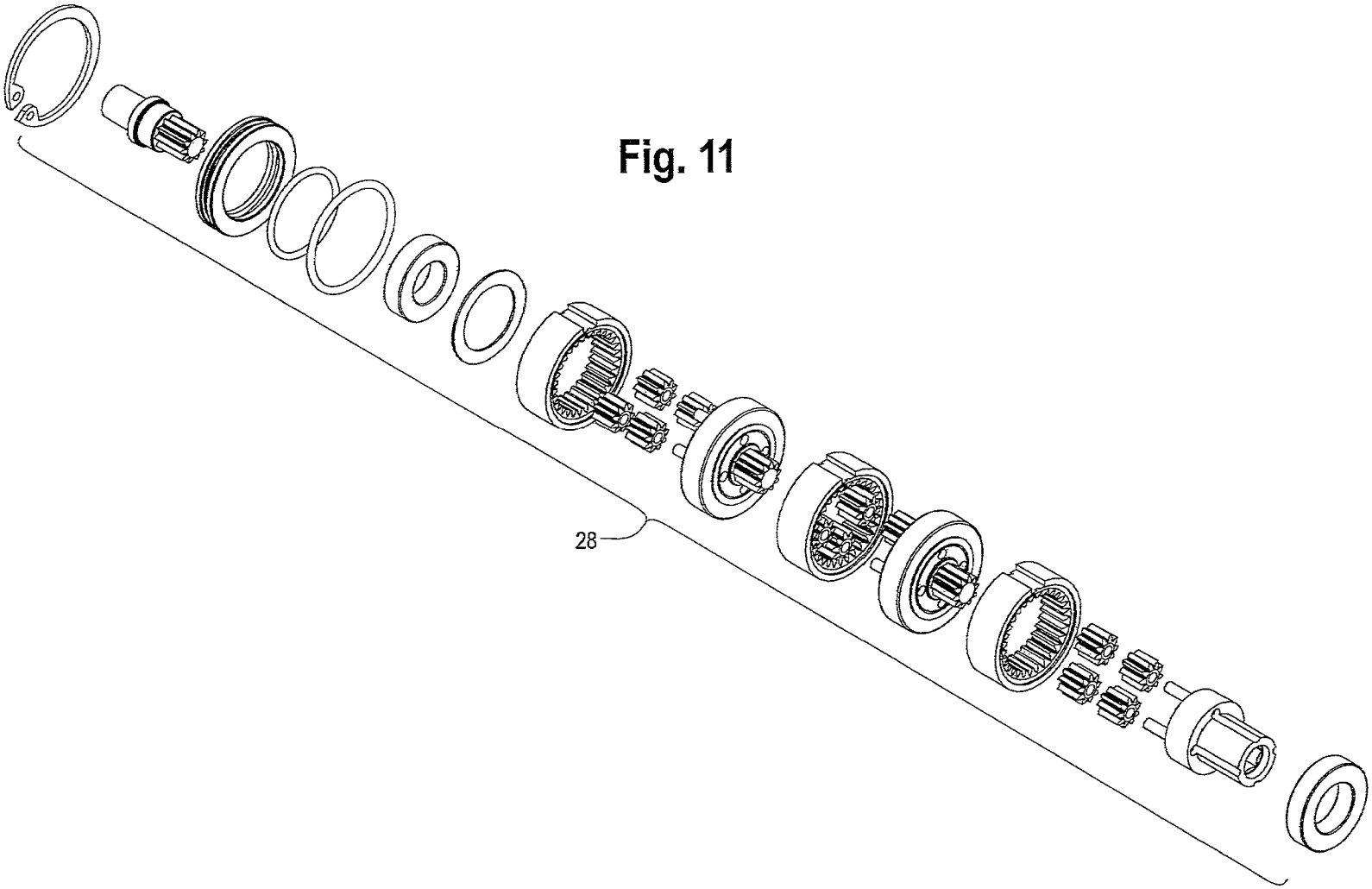
FIG. 11 is an exploded view of a planetary gear set in the drive train.
Figure 12:
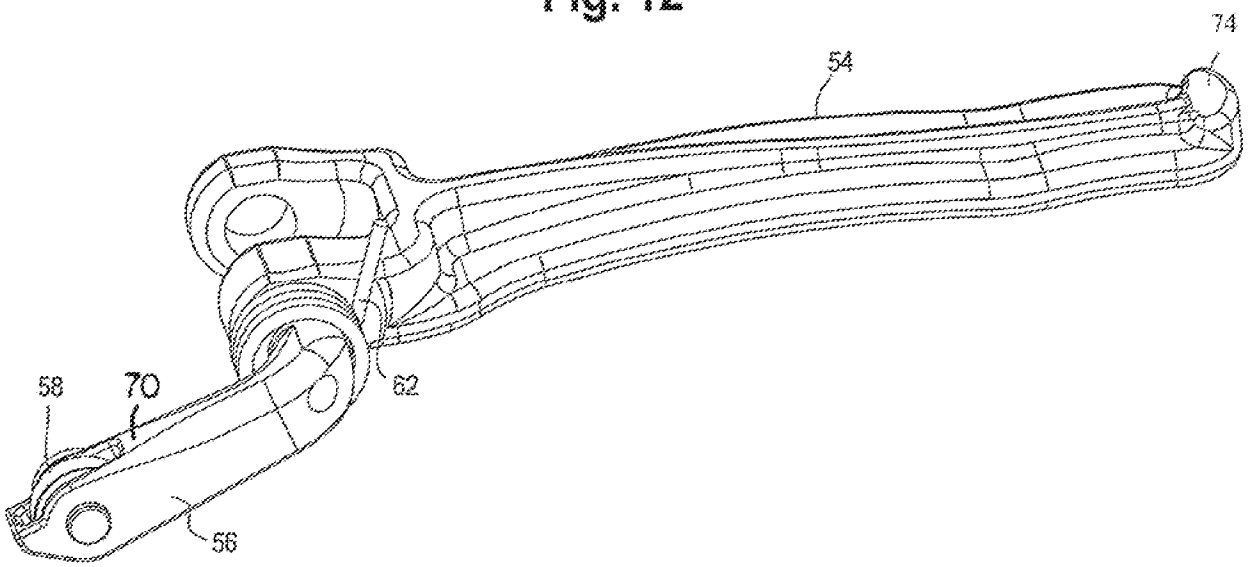
FIG. 12 is a perspective view of the actuator handle.
Figure 13:
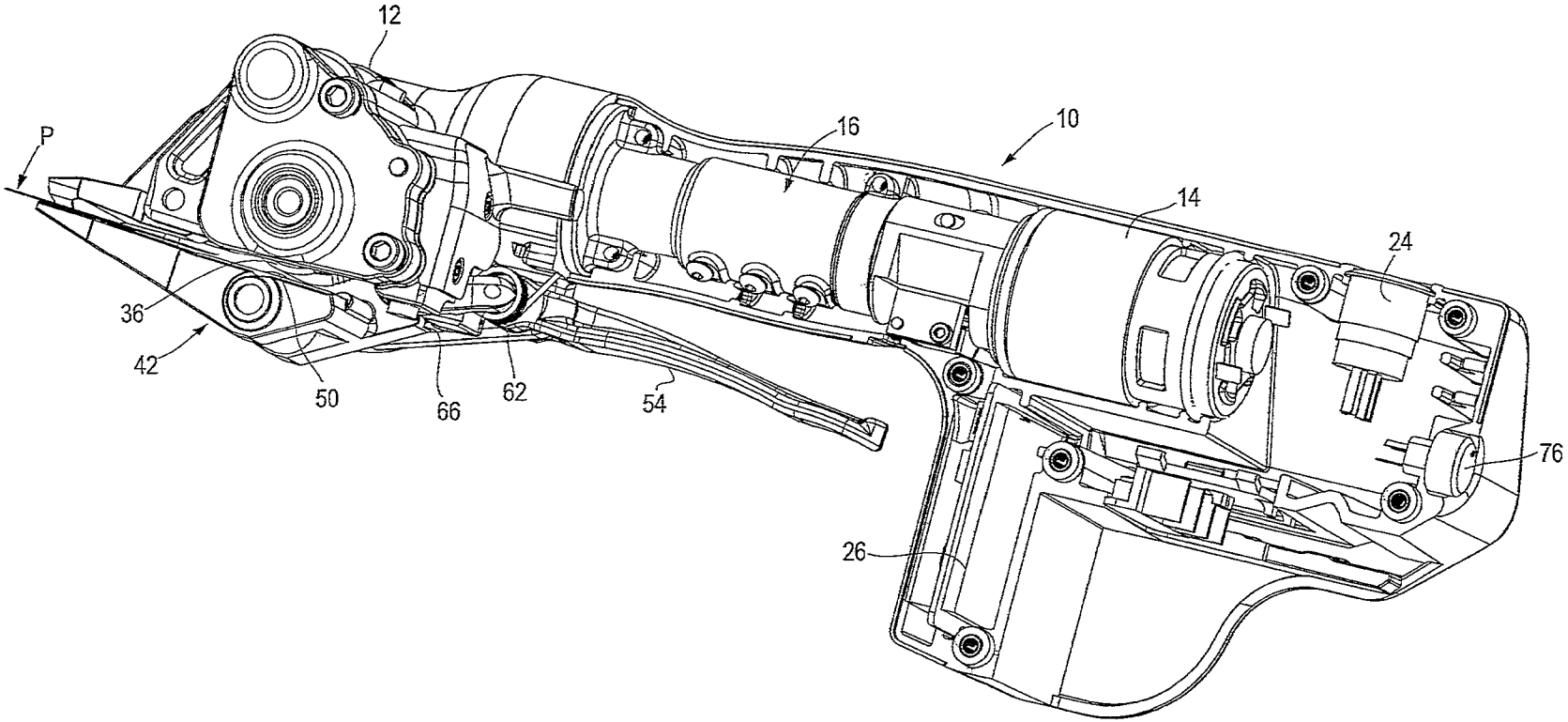
FIG. 13 is a side view of the tensioner, shown with a side of the housing removed for clarity of illustration.
Figure 14:
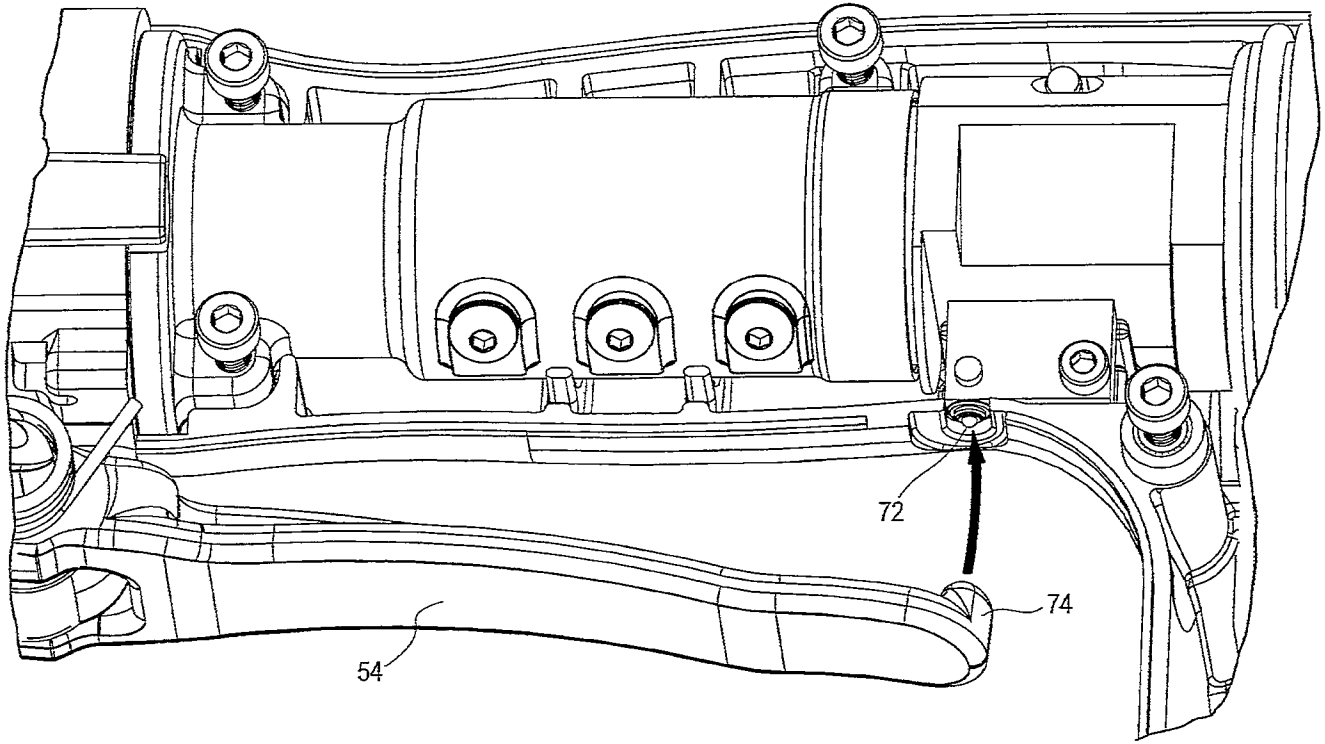
FIG. 14 is partial view of the housing showing a tool wake switch.

Referring briefly to FIGS. 5-7, the motor 14 and drive train 16 are positioned in the housing 18. The drive train 16 includes a gear set 28, for example, a planetary gear set as shown in FIG. 11, to reduce the output speed of the motor 14 and to increase the power from the motor 14. In an embodiment, the gear set 28 includes three planetary gears to reduce the output speed of the motor 14 and to increase power (torque) to a final drive 30. The final drive 30, which is positioned in the tension head 12, includes a linear gear 32 that meshes with and drives a gear 34 operably mounted to a tension wheel 36. A bearing 38 can be positioned to facilitate smooth operation of the final drive 30. In an embodiment, the bearing 38 is positioned downstream of the planetary gear set 28 on the final drive output shaft 40. The tension wheel 30 is mounted in a stationary manner in the tension head 12 and is driven by the shaft 40.

Figure 9:
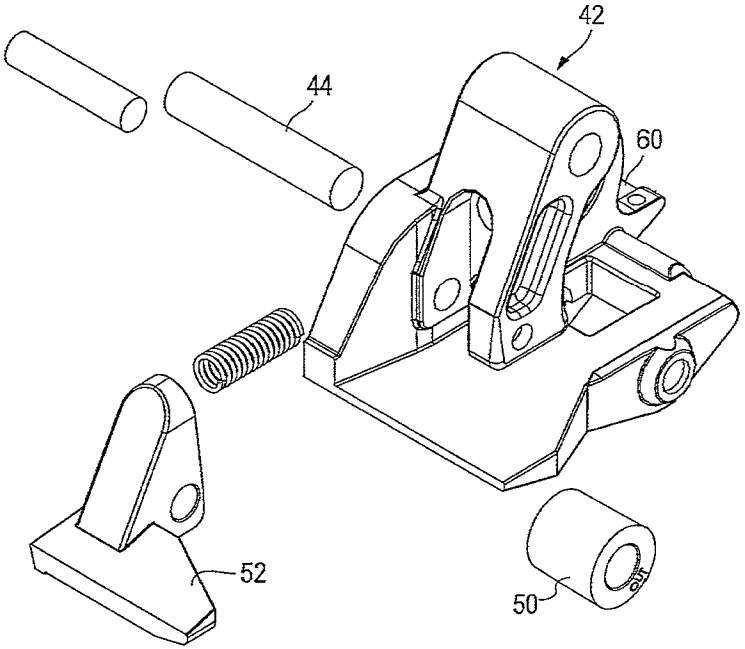
FIG. 9 is an exploded view of the nosepiece.
Figure 10:
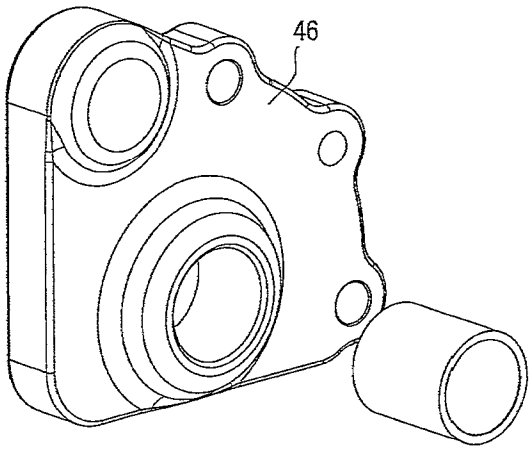
FIG. 10 is a perspective view of a side plate.

A nosepiece or carriage 42 is pivotally mounted to the tension head 12. The nosepiece 42 is mounted to the tension head 12 by a pivot pin 44 extending from a side plate 46, through the nosepiece 42 and to tension head 12. The side plate 46 is affixed to the tension head 12 by, for example, fasteners 48. A pinch element 50, such as the example pinch wheel, is positioned opposing the tension wheel 36 and defines a strap path P between the tension wheel 36 and pinch wheel 50. The nosepiece 42 pivots downwardly and forwardly to open a gap G between the tension wheel 36 and pinch wheel 50 to allow for positioning the strap S for operation. Referring to FIG. 9, a foot 52 is mounted to the nosepiece 42 and is biased onto the nosepiece 42 to capture the strap S therebetween.

An actuator handle 54 is operably mounted to the tension head 12 and nosepiece 42 to open and close the nosepiece 42 relative to the tension head 12. In an embodiment, the handle 54 is located below the housing 18 to allow a user to pull the handle 54 upward, toward the housing 18 to open or pivot the nosepiece 42 open. This arrangement provides a natural and ergonomically comfortable design in that the tensioner housing 18 can be cradled in a user's hand and the user's fingers can open the tensioner 10, e.g., urge the pinch wheel 50 away from the tension wheel 36, by pulling the handle 54 toward the housing 18.

Figure 15:
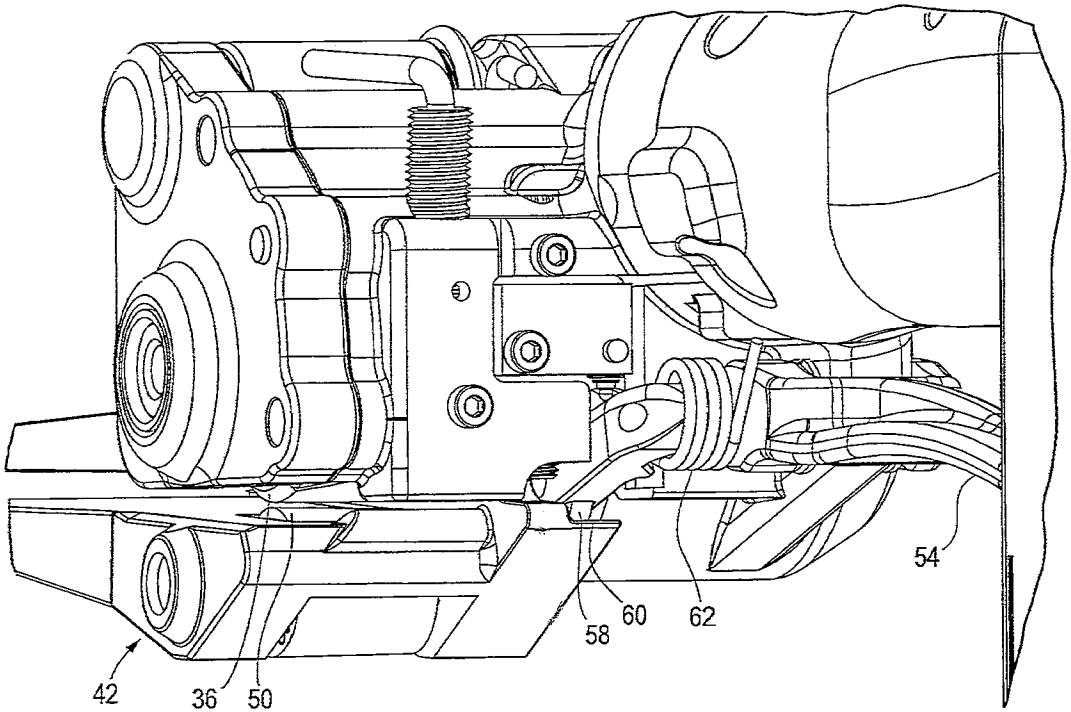
FIGS. 15 and 16 are rear perspective views of the tensioning tool shown with the nosepiece in the closed position (FIG. 15) and in the open position (FIG. 16)
Figure 16:
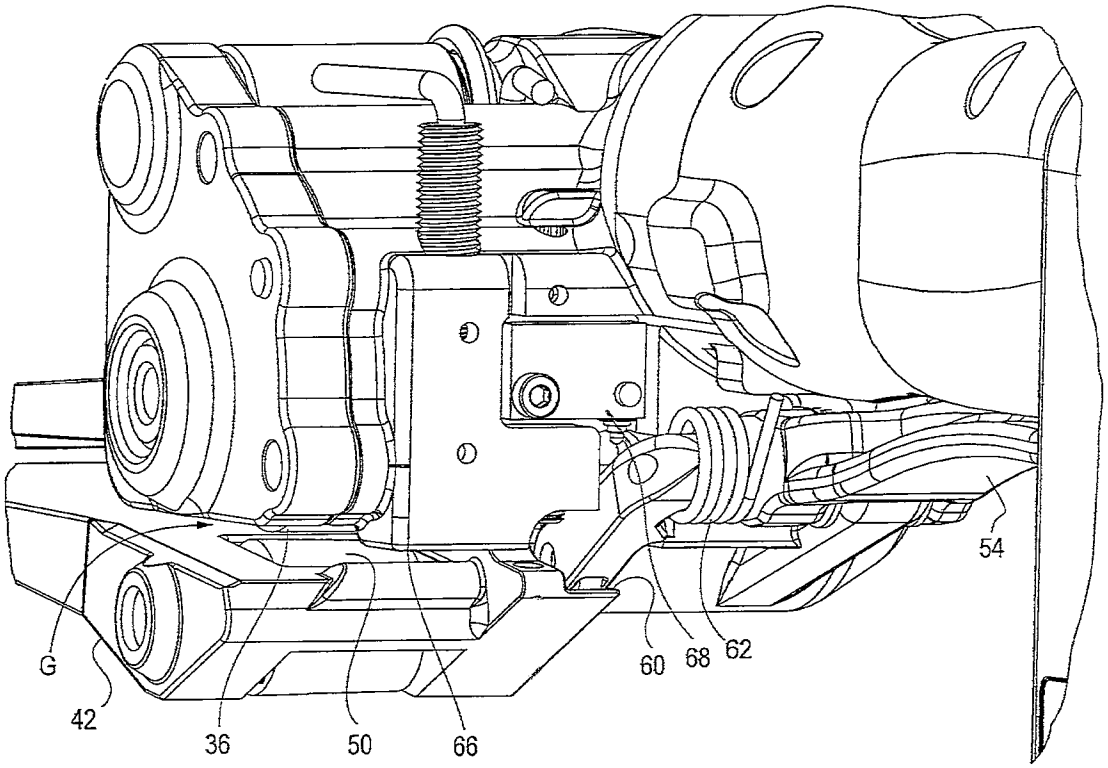
Figure 17:
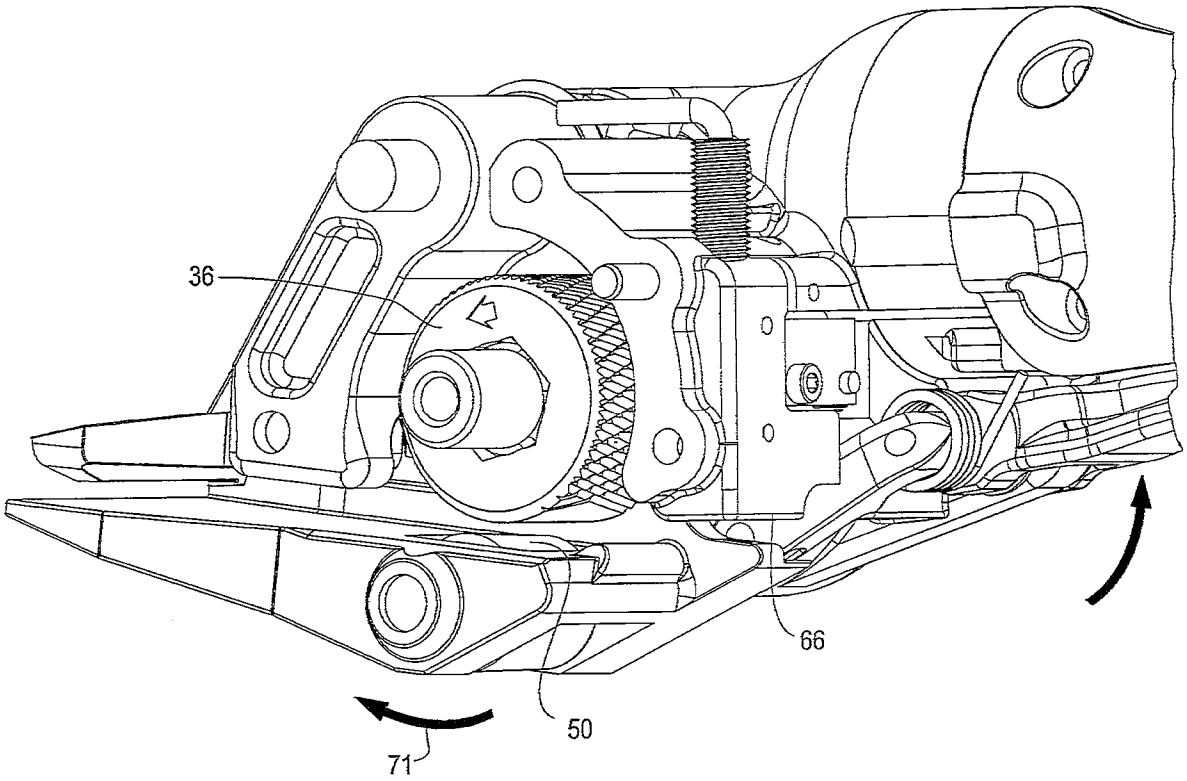
FIG. 17 is a side view of the tensioner with the side plate of the tension head removed for clarity of illustration, showing the movement of the nosepiece relative to the tension head as the handle is pulled toward the housing.

To accomplish pivotal movement of the nosepiece 42, in an embodiment, the tensioner 10 includes a linkage or arm 56 with a camming element 58, such as the illustrated roller mounted to an end of the arm 56. The roller 58 engages a cam surface 60 on the nosepiece 42 (see, FIGS. 5 and 15-16) which pivots the nosepiece 42 forwardly and in an arcuate path (as indicated at 61 in FIG. 17) away from the tension head 12. This opens the gap G between the tension wheel 36 and the pinch wheel 50. Releasing the handle 54 allows the nosepiece 42 to return to the closed position, in which the tensioner 10 is ready for operation. The roller 58 is maintained in engagement with the cam surface 60 by a spring 62 located at about the handle pivot 64.

In an embodiment, the tensioner 10 includes a number of switches and sensors, all of which are in communication with the controller 26. The actuation switch 24, noted above, is located on the housing 18. The actuation switch 24 actuates the tensioner 10. In an embodiment, the actuation switch 24 can function to provide power to the tensioner 10 (e.g., turn on the tensioner 10), and can be used to change between operating mode, such as between an automatic mode and a manual mode.

A strap sensor 66 can be located within the tension head 12. The strap sensor 66 senses the presence or absence of strap S in the strap path P. As will be discussed in more detail below, the strap sensor 66 communicates with the controller 26 to allow the motor 14 to operate when strap S is sensed by the strap sensor 66 and when the tensioner 10 is powered.

A home position switch or sensor 68 can also be located in the tension head 12. The home position switch 68 senses when the nosepiece 42 is or is not in the fully closed position. The home position switch 68 is in a first state when the nosepiece 42 is fully closed and there is no strap in the tensioner 10. In a second state, the tensioner is other than fully closed, for example, when the tensioner 10 is open or when there is strap S in the tensioner 10 (e.g., between the tension and pinch wheels 36, 50).

The home position switch 68 can be actuated by a home switch contact member 70. In an embodiment, the home position switch contact member 70 can be positioned on or formed as part of the arm 56. The home position switch 68 changes state when the home switch contact member 70 contacts the home position switch 68 or moves out of contact with the home position switch 68 (e.g., moving the handle 54 to open the tensioner 10). The tensioner 10 can also include a handle position switch 72 located on the housing 18 that is actuated (or changes state) when a finger or like element 74 on the handle 54 contacts the switch 72. A tension adjustment switch 76, such as an adjusting knob can be located on the tensioner 10. In an embodiment, the tension adjustment knob 76 is positioned at a rear of the tensioner 10, above the battery 22, and can be recessed, to allow for ease of tension adjustment, while maintaining the switch (knob) 76 in a location that reduces the opportunity for inadvertently changing the tension.

Figure 8:
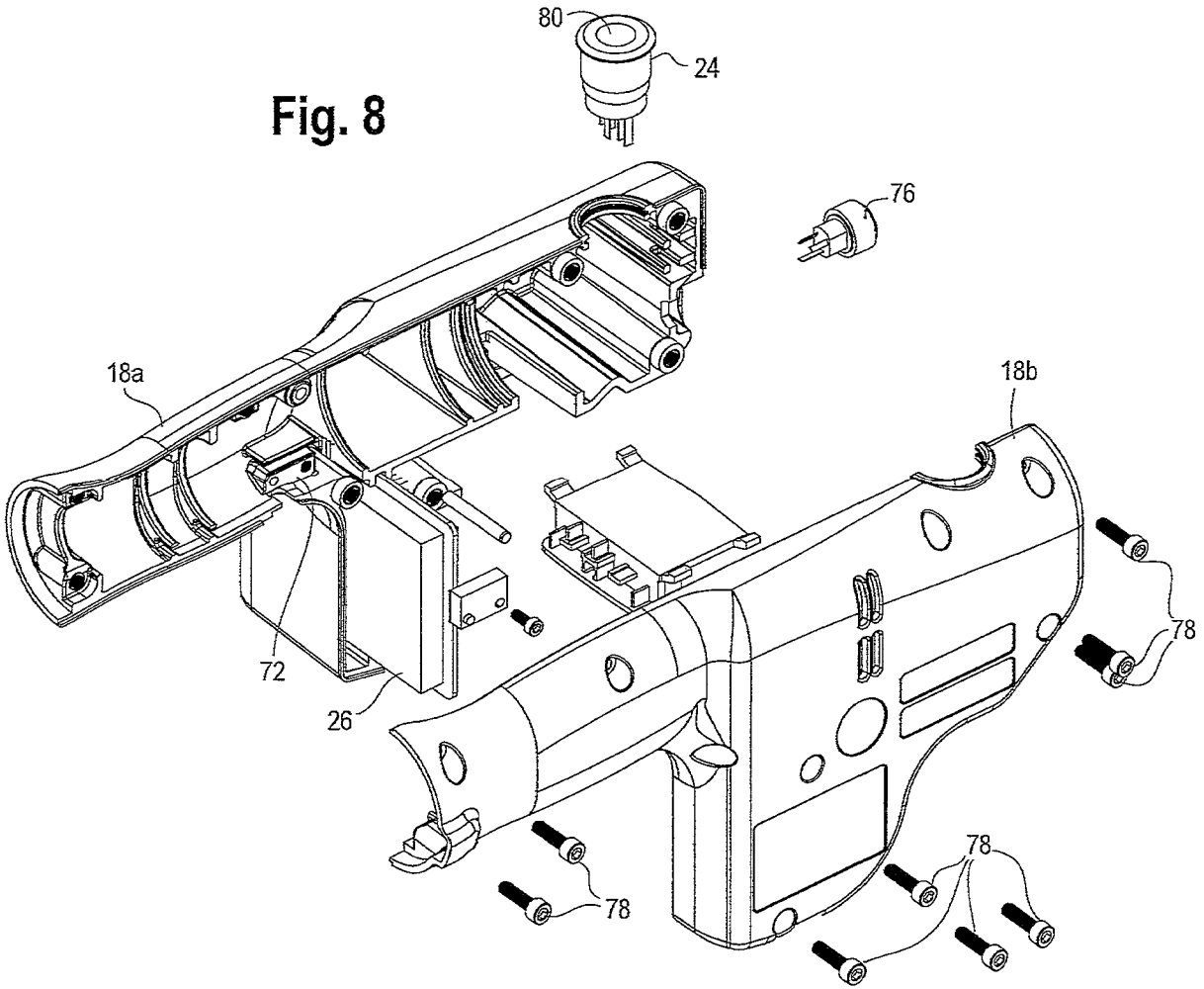
FIG. 8 is an exploded view of the tensioner housing.

The tensioner 10 can be configured as a modular tool. As seen in FIGS. 5 and 7-8, the two sections 18*a*, 18*b* of the housing 18 can fasten to one another by fasteners 78, such as the illustrated bolts. The controller 26 can be a modular component that is secured between the two housing sections 18*a*, 18*b*. The motor 14 can be a separate part that can mate with the drive train 16, which can also be a separate, modular component. The tension head 12, handle 54 and nosepiece 42 also mount to the housing 18 (with the tension head final drive 36 mating with the drive train 16). In this manner, maintenance and repair of the tensioner 10 is readily carried out.

Figure 18:
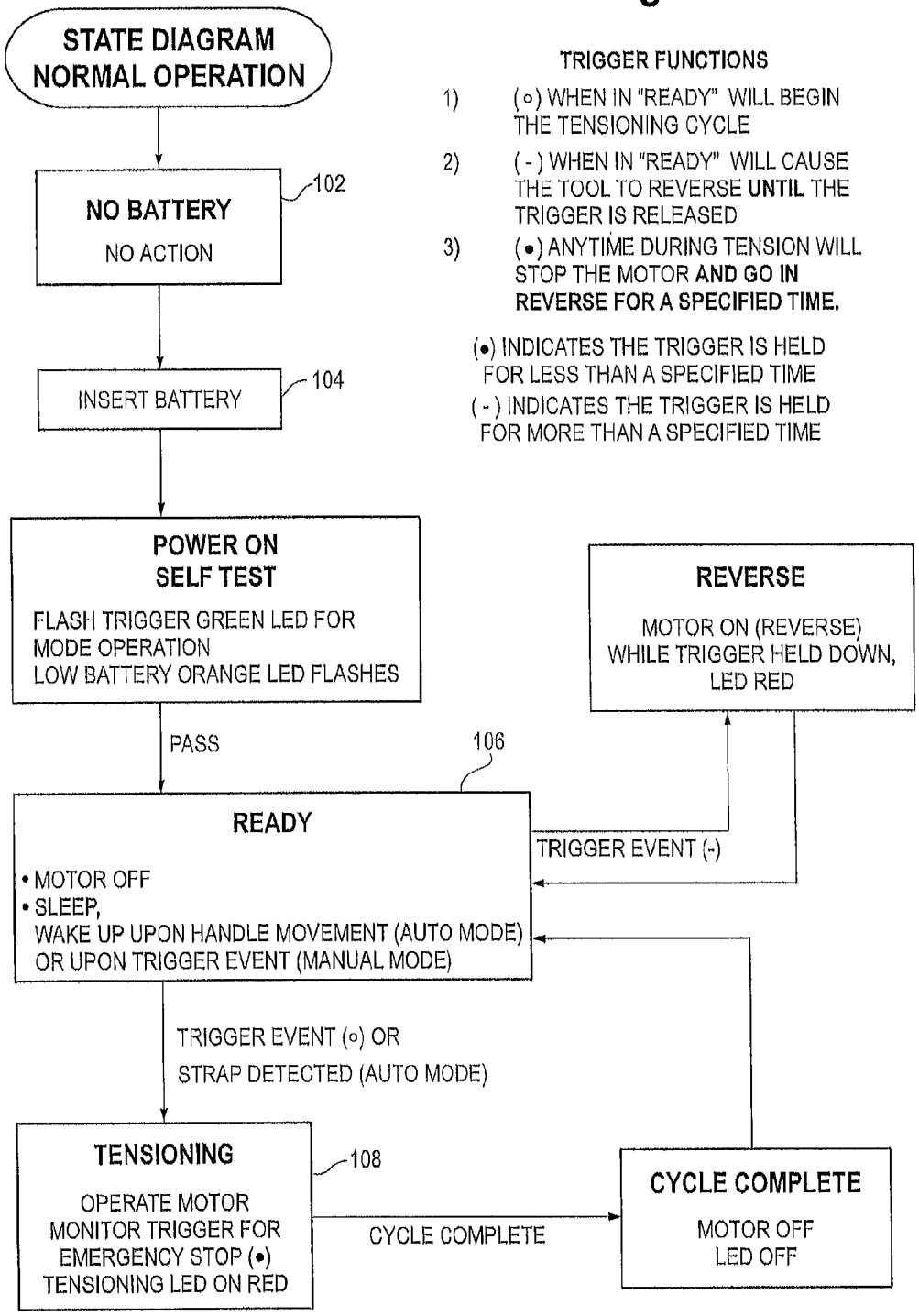
FIG. 18 is a block diagram showing one embodiment of an automatic mode of operation of the tensioner.

Referring to FIG. 18, in an embodiment, the tensioner 10 can function in an automatic operating mode. A battery 22 is installed in the tensioner 10 (at block 102) and the tensioner 10 performs a self-test (at block 104). Indicators, such as LEDs in, for example, the actuation switch 24, can provide indication that the tensioner 10 is ready for operation, indication of the battery power level, and the like.

Once the tensioner 10 successfully completes the self-test, it is ready for operation (at block 106). In automatic mode, the tensioner 10 operates through the tension cycle automatically (at block 108). Alternatively, the tensioner 10 can be operated in a manual mode, in which the steps of the tension cycle progress through manual operator action.

In automatic mode, starting with the tensioner 10 at rest and without strap in the tensioner 10, the nosepiece 42 is fully closed on the tension head 12 and the home position switch 68 is in a first state. The actuator handle 54 is grasped and moved (pulled) toward the housing 18, which pivots the nosepiece 42 to open the gap G between the tension wheel 36 and pinch wheel 50. Moving (pulling) the handle 54 moves the home switch contact member 70 off of the home position switch 68, changing the state of the switch 68 (to a second state), to allow the tensioner 10 to enter the tension cycle. That is, changing the state of the home position switch 68 generates a signal to the controller 26 that allows the motor 14 to start.

Further pulling the handle 54 engages the finger 74 on the handle 54 with the handle position switch 72 which changes the state of the handle position switch 72 and generates a signal to the controller 26 to "wake" the tensioner 10 from a sleep mode (e.g., when not in use for a period of time, the tensioner 10 goes into a "sleep" or low power mode to conserve power and battery life).

Figure 2:
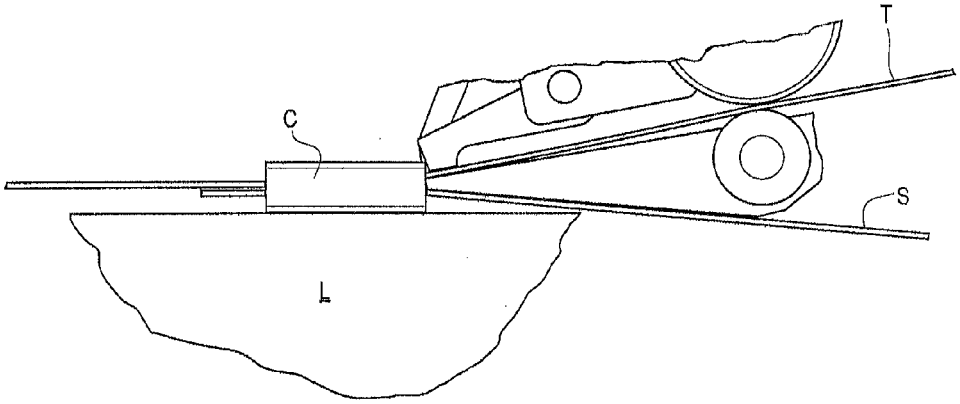
FIG. 2 is an enlarge view of a portion of a tensioning tool or tensioner positioned on a load with strap positioned in the tensioner and a crimp seal positioned on the strap.

Strap S which was previously positioned around a load L with a loop of strap made, and a crimp seal C loosely positioned on the overlying courses of strap S (see, FIGS. 1 and 2), is then positioned in the tensioner 10, on the nosepiece 42, under the foot 52, and between the tension wheel 36 and the pinch wheel 50. The strap sensor 66 senses the presence of strap S in the strap path and generates a signal to the controller 26.

The handle 54 is then released to close the nosepiece 42. As the nosepiece 42 closes, the home position switch 68 remains in the second state. With the home position switch 68 in the second state, and the strap sensor 66 sensing strap S in the strap path P, the controller 26 sends a signal to the motor 14 to commence the tension cycle. The controller 26 can be configured to include a slight delay (e.g., 5 seconds) between the time the finger 74 disengages from the handle position switch 72 and the strap sensor 66 senses the presence of strap S, and when the motor 14 starts.

As tension increases, the current drawn by the motor 14 increases. When a preset current is reached (which corresponds to reaching a predetermined tension), the controller 26 signals the motor 14 to stop and the tension cycle is complete. The seal C is then crimped on the overlying courses of strap S. The controller 26 can be configured to reverse the motor 14 by, for example, holding the actuating switch 24 (or depressing the switch 24 for a period of time longer than to initiate operation), which signals the controller 26 to reverse the motor 14 direction. The tensioner 10 is then rocked back and forth (with the strap S still positioned between the tension and pinch wheels 36, 50 and with the seal C abutting the nosepiece 42) to separate the strap S from the feed or source.

After the strap S is separated, there is a tail T of strap (see FIG. 2) that remains in the tensioner 10, between the tension and pinch wheels 36, 50. Because the home position switch contact member 70 may not have returned to contact the home position switch 68, (with strap present between the tension and pinch wheels 36, 50, the contact member 70 may be prevented from contacting the switch 68), the switch 68 may remain in the second state, the controller 26 may not be reset, and the motor 14 may be prevented from actuating.

After the nosepiece 42 has been opened and the strap tail T removed, the home position switch contact member 70 engages the home position switch 68, to reset the operating program (the controller 26), which then allows the tensioner 10 to reenter the tensioning cycle if all of the operating conditions are met (e.g., a subsequent section of strap S is positioned between the wheels 36, 50 and sensed by the strap sensor 66 and the handle position switch finger 74 has engaged and subsequently disengaged from the handle position switch 72).

As noted above, the actuation switch 24 can be used to change between operating modes, for example, between manual and automatic modes, and can be used to stop and reverse the motor 14 when the tensioner 10 is operating in either manual or automatic mode. As noted above, the switch 24 can include LEDs or the like that indicate the mode of operation, the status of the tensioner 10, fault modes/conditions, battery power and the like.

In addition, in the event that the tensioner 10 is stopped prior to the completion of a cycle, following removal and repositioning of the strap S, the operating program (the controller 26) will reset, again, when all of the operating conditions are met, to allow the cycle to recommence when a subsequent section of strap S is positioned between the tension and pinch wheels 36, 50 and sensed by the strap sensor 66.

It should be understood that various changes and modifications to the presently disclosed embodiment will be apparent to those skilled in the art. Such changes and modifications can be made without departing from the spirit and scope of the present disclosure and without diminishing its intended advantages. It is therefore intended that such changes and modifications be covered by the appended claims.

What is claimed is:

1. A tensioner for strap, comprising:

a housing;

a local power supply removably mounted to the housing;

a motor positioned in the housing;

a tension head mounted to the housing;

a tension wheel positioned in the tension head, the tension wheel operably connected to the motor;

a nosepiece operably mounted to the tension head for movement relative to the tension wheel, the nosepiece including a pinch element, the nosepiece being biasedly mounted to bias the pinch element toward the tension wheel;

an actuator handle operably connected to the nosepiece to move the pinch element toward and away from the tension wheel;

a strap sensor located in the tension head and positioned to sense the presence and/or absence of strap between the tension wheel and the pinch element;

a home position switch;

a home position switch engaging element for engaging the home position switch when the pinch element is in proximity to the tension wheel; and a controller positioned in the housing and operably connected to the strap sensor and the home position switch, wherein when the nosepiece is moved away from the tension head to introduce strap between the tension wheel and the pinch element, the home position switch engaging element disengages from the home position switch changing the state of the home position switch to signal the controller to permit actuation of the motor when the strap sensor senses the presence of strap between the pinch element and the tension wheel.

2. The tensioner of claim 1 including an actuation switch operably connected to the controller.

3. The tensioner of claim 2 wherein the actuation switch generates a signal to the controller to reverse a direction of the motor.

4. The tensioner of claim 2 wherein the actuation switch is a push-button type switch.

5. The tensioner of claim 1 including a wake switch to wake the tensioner from a sleep state.

6. The tensioner of claim 5 wherein the wake switch is engaged by an engaging element on the handle.

7. The tensioner of claim 1 wherein the local power supply is a battery, and wherein the tensioner includes a battery holder.

8. The tensioner of claim 7 wherein the battery is detachably mounted to the housing.

9. The tensioner of claim 4 wherein the signal is generated by a prolonged depression of the actuation switch.

10. The tensioner of claim 1 wherein the strap sensor is a proximity switch and wherein the proximity switch detects the presence and/or absence of strap positioned between the tension wheel and the pinch element, and wherein upon sensing the absence of strap between the tension wheel and the pinch element the strap sensor generates a signal to the controller to prevent actuation of the motor.

11. The tensioner of claim 1 including a drive train operably connected to the motor and to the tension wheel.

12. The tensioner of claim 11 wherein the drive train includes a speed reduction gear set.

13. A tensioner for strap having an automatic tensioning cycle, comprising:

a housing;

a power supply removably mounted to the housing;

a motor positioned in the housing;

a tension head mounted to the housing, the tension head having a tension wheel operably connected to the motor;

a nosepiece biasedly mounted to the tension head for movement relative to the tension head between an open state and a closed state, the nosepiece including a pinch wheel;

a controller positioned in the housing;

a home position switch operably connected to the controller, the home position switch configured for determining when the nosepiece is in the closed state; and a strap sensor located in the tension head and operably connected to the controller and positioned to sense the presence and/or absence of strap between the tension wheel and the pinch wheel;

wherein in the automatic tensioning cycle, when the nosepiece is in the closed state, the home position switch generates a signal to the controller to reset the controller, and when the nosepiece is moved from the closed state to the open state, the home position switch generates a signal to the controller to allow actuation of the motor when the strap sensor senses the presence of strap between the tension wheel and the pinch wheel.

14. The tensioner of claim 13 including an actuation switch operably connected to the controller, the actuation switch configured to, at least in part, generate a signal to the controller to reverse a direction of the motor.

15. The tensioner of claim 14 wherein the actuation switch is a push-button type switch.

16. The tensioner of claim 13 wherein the strap sensor is a proximity switch and wherein the proximity switch detects the presence and/or absence of strap positioned between the tension wheel and the pinch wheel, and wherein sensing the absence of strap between the tension wheel and the pinch wheel prevents actuation of the motor.

17. The tensioner of claim 13 wherein the power supply unit is a battery detachably mounted to the housing.

18. The tensioner of claim 13 including a drive train operably connected to the motor and to the tension wheel.

19. The tensioner of claim 18 wherein the drive train includes a speed reduction gear set.

20. The tensioner of claim 18 wherein the motor, the controller and the drive train are modular and wherein each the motor, the controller and the drive train are removable as individual components from the tensioner.

21. A tensioner for strap, comprising:

a housing;

a local power supply removably mounted to the housing;

a motor mounted in the housing;

a tension head mounted to the housing;

a tension wheel positioned in the tension head, the tension wheel operably connected to the motor;

a nosepiece operably mounted to the tension head for movement relative to the tension wheel between an open state and a closed state, the nosepiece including a pinch element, the nosepiece being biasedly mounted to bias the pinch element toward the tension wheel;

an actuator handle operably connected to the nosepiece to move the pinch element toward and away from the tension wheel;

a controller mounted in the housing;

a home position switch operably connected to the controller, the home position switch configured for determining when the nosepiece is in the closed state; and a strap sensor operably connected to the controller and positioned to sense the presence and/or absence of strap between the tension wheel and the pinch element, wherein the nosepiece is moved away from the tension head to introduce strap between the tension wheel and the pinch element.

22. The tensioner of claim 21 including an actuation switch operably connected to the controller.

23. The tensioner of claim 21 wherein the local power supply is a detachable battery, and wherein the tensioner includes a battery holder.

24. The tensioner of claim 21 including a drive train operably connected to the motor and to the tension wheel.

25. The tensioner of claim 24 wherein the drive train includes a speed reduction gear set.

* * * * *